US010612168B2

(12) United States Patent
Suzuki

(10) Patent No.: US 10,612,168 B2
(45) Date of Patent: Apr. 7, 2020

(54) GLOVE AND MANUFACTURING METHOD OF GLOVE

(71) Applicant: SHOWA GLOVE CO., Himeji-shi, Hyogo (JP)

(72) Inventor: Wataru Suzuki, Hyogo (JP)

(73) Assignee: SHOWA GLOVE CO., Hyogo (JP)

( * ) Notice: Subject to any disclaimer, the term of this patent is extended or adjusted under 35 U.S.C. 154(b) by 225 days.

(21) Appl. No.: 15/648,597

(22) Filed: Jul. 13, 2017

(65) Prior Publication Data

US 2018/0030628 A1 Feb. 1, 2018

(30) Foreign Application Priority Data

Jul. 28, 2016 (JP) ..... 2016-148805

(51) Int. Cl.
*D04B 1/28* (2006.01)
*A41D 31/12* (2019.01)
*A41D 31/102* (2019.01)

(52) U.S. Cl.
CPC ..... *D04B 1/28* (2013.01); *A41D 31/102* (2019.02); *A41D 31/12* (2019.02); *A41D 2500/10* (2013.01); *D10B 2403/02* (2013.01)

(58) Field of Classification Search
CPC . D04B 1/104; D04B 1/28; D04B 7/28; D04B 7/34; D04B 9/58; A41D 2500/10
See application file for complete search history.

(56) References Cited

U.S. PATENT DOCUMENTS 2,050,998 A * 8/1936 Ganson ..... D04B 1/24 66/174
2,082,779 A * 6/1937 Buchholz ..... D04B 1/28 66/172 R
2,090,982 A * 8/1937 Mills ..... D04B 1/28 66/174
2,849,786 A * 9/1958 Hindle ..... A41D 19/0065 66/174

(Continued)

FOREIGN PATENT DOCUMENTS

JP H06-51220 U 7/1994
JP 2008-214775 9/2008

(Continued)

*Primary Examiner* — Danny Worrell
(74) *Attorney, Agent, or Firm* — Norris McLaughlin, P.A.

(57) ABSTRACT

Provided is a glove superior in breathability, sweat-absorbent and quick-drying properties, and wearing feel. The glove comprises a knitted fabric constituted from stitches arranged successively in a course direction and engaged with corresponding stitches in a wale direction. The knitted fabric comprises at least one irregular surface portion comprising tucked parts arranged in a scattered manner, and at least one rib portion in proximity to the irregular surface portion and provided along the course direction. The tucked parts are preferably arranged uniformly in both the course direction and the wale direction in the irregular surface portion. The rib portion comprises: a cylindrical rib main body part constituted from stitches arranged successively in the course direction and engaged with corresponding stitches arranged in the wale direction, with a region between base ends being contracted; and a filling part subsequent to the rib main body part in the course direction.

6 Claims, 8 Drawing Sheets

(56) References Cited

U.S. PATENT DOCUMENTS

| | | | | | |
|---|---|---|---|---|---|
| 4,057,981 | A * | 11/1977 | Runac | D04B 1/26 | 66/185 |
| 5,724,836 | A * | 3/1998 | Green | A41B 11/00 | 66/185 |
| 6,931,762 | B1 * | 8/2005 | Dua | A43B 1/04 | 66/185 |
| 7,587,915 | B2 * | 9/2009 | Kaneda | D04B 1/26 | 66/185 |
| 8,973,411 | B2 * | 3/2015 | Gaither | A61F 13/08 | 66/182 |
| 2009/0044571 | A1 * | 2/2009 | Thompson | A31D 19/0096 | 66/174 |
| 2013/0205469 | A1 * | 8/2013 | Thompson | A41D 19/015 | 66/174 |
| 2018/0030628 | A1 * | 2/2018 | Suzuki | A41D 19/01505 | |

FOREIGN PATENT DOCUMENTS

| | | |
|---|---|---|
| JP | 2008-303515 | 12/2008 |
| JP | 2013-151778 A | 8/2013 |

* cited by examiner

GLOVE AND MANUFACTURING METHOD OF GLOVE

BACKGROUND OF THE INVENTION

The present invention relates to a glove and a manufacturing method of a glove.

DESCRIPTION OF THE RELATED ART

As a glove knitted by using a knitting machine, a glove having flat portions and rib portions provided on finger pouches and a palm portion along a course direction for improved cut resistance has been proposed (Japanese Unexamined Patent Application, Publication No. 2013-151778).

The glove disclosed in the aforementioned publication may not have sufficient breathability and sweat-absorbent and quick-drying properties due to a greater thickness in the rib portions. In addition, since an irregular face knitted to have the rib portions and the flat portions has a flat back face, the flat portions may cling to a wearer's hand when worn, leading to a failure to provide satisfactory wearing feel.

PRIOR ART DOCUMENTS

Patent Documents

Patent Document 1: Japanese Unexamined Patent Application Publication No. 2013-151778

SUMMARY OF THE INVENTION

In view of the aforementioned drawbacks, an objective of the present invention is to provide: a glove superior in breathability, sweat-absorbent and quick-drying properties, and wearing feel; and a production method of the glove.

According to an aspect of the invention made for solving the aforementioned problems, a glove comprises a knitted fabric, wherein: the knitted fabric is constituted from a plurality of stitches arranged successively in a course direction and engaged with corresponding stitches arranged in a wale direction; and the knitted fabric comprises at least one irregular surface portion comprising a plurality of tucked parts that are arranged in a scattered manner, and at least one rib portion that is provided in proximity to the irregular surface portion and along the course direction.

Due to the irregular surface portion comprising a plurality of tucked parts that are arranged in a scattered manner, the glove is superior in breathability in the irregular surface portion and also superior in sweat-absorbent and quick-drying properties, and wearing feel.

It is preferred that the plurality of tucked parts are arranged in the irregular surface portion uniformly in both the course direction and the wale direction. This enables an improvement in breathability in both the course direction and the wale direction, and in turn improvements of the sweat-absorbent and quick-drying properties, and wearing feel.

It is preferred that each of the plurality of tucked parts is formed in such a way that at least three stitches that are adjacent to one stitch in the wale direction engage with the one stitch. Due to engagement of the at least three stitches with the one stitch in the tucked part, a breathability improving effect at the tuck part is further enhanced.

It is preferred that the rib portion has a rib main body part having a cylindrical shape constituted from a plurality of stitches arranged successively in the course direction and engaged with corresponding stitches arranged in the wale direction, with a region between a pair of base ends of the rib main body part being contracted. Due to providing the rib main body part having the cylindrical shape with the region between the pair of base ends being contracted, the rib portion is enabled to be formed correctly and easily.

It is preferred that the rib portion comprises a filling part formed with a stitch that is subsequent in the course direction from the stitches of the rib main body part, and that the number of the stitch in the wale direction in the filling part is less than the number of the stitches in the wale direction in the rib main body part. Due to such a filling part, correct preclusion of a void at a side end of the rib main body part is enabled.

It is preferred that the irregular surface portion is arranged to be adjacent to at least one side of the rib main body part in the wale direction; and a stitch at one of the pair of base ends of the rib main body part has at least two stitches that are adjacent to the stitch in the wale direction being engaged. The rib main body part and the irregular surface portion being arranged adjacently result in superior breathability of a part in proximity to the rib main body part. Due to the stitch at one of the pair of base ends of the rib main body part having at least two stitches (stitches in the irregular surface portion) that are adjacent to the stitch in the wale direction being engaged therewith, joint strength between the rib main body part and the irregular surface portion is increased, and ensuring of breathability in these parts is enabled.

With regard to the glove, it is preferred that: a pair of the irregular surface portions is arranged to be adjacent to both sides of the rib main body part in the wale direction; and among a plurality of stitches in one irregular surface portion that are adjacent to the rib main body part, at least one stitch engages with a stitch in the other irregular surface portion. Due to thus engaging the stitch in the irregular surface portion on one side with the stitch in the irregular surface portion on the other side, easy and certain formation of the rib portion is enabled.

In a case of adopting the aforementioned configuration, it is preferred that the at least one stitch in the irregular surface portion on the one side engages with the stitch in the irregular surface portion on the other side, together with at least one stitch among a plurality of stitches in the irregular surface portion on the other side that are adjacent to the rib main body part. Due to both the stitch in the irregular surface portion on the one side and the stitch among a plurality of stitches in the irregular surface portion on the other side that are adjacent to the rib main body part engaging with the stitch in the irregular surface portion on the other side, more certain formation of the rib portion and ensuring of breathability in the rib portion are enabled.

According to another aspect of the invention made for solving the aforementioned problems, a production method of a glove, the glove being constituted from a plurality of stitches arranged successively in a course direction and engaged with corresponding stitches arranged in a wale direction, the production method comprising: knitting an irregular surface portion comprising a plurality of tucked parts that are arranged in a scattered manner; and knitting a rib portion that is in proximity to the irregular surface portion and provided along the course direction.

The production method of a glove enables production of a glove having the aforementioned advantages. In other words, the glove produced by the production method is superior in breathability in the irregular surface portion and also superior in sweat-absorbent and quick-drying properties, and wearing feel, due to comprising the irregular surface portion comprising a plurality of tucked parts that are arranged in a scattered manner.

Effects of the Invention

As explained in the foregoing, the glove of the aspect of the present invention and the glove produced by the production method of the another aspect of the present invention are superior in breathability, sweat-absorbent and quick-drying properties, and wearing feel to the conventional gloves.

DESCRIPTION OF THE EMBODIMENTS

Embodiments of the present invention are described in detail hereafter with reference to the Drawings as necessary.

Glove

A glove according to the present embodiment is formed by knitting a yarn made from fibers into a glove shape. Specifically, the glove comprises a knitted fabric constituted from a plurality of stitches 2*a* arranged successively in a course direction C and engaged with corresponding stitches 2*a* arranged in a wale direction W. More specifically, in the knitted fabric of the glove, the plurality of stitches 2*a* are provided successively in the course direction C and engage with the plurality of stitches 2*a* in another course formed in the wale direction W.

The glove comprises a hem portion, a trunk pouch portion and finger pouch portions, and is a member for protecting a wearer's hand. Specifically, a five finger trunk portion is provided on a fingertip side of the hem portion, the hem portion having an opening through which the wearer's hand can be inserted. A four finger trunk portion and a first finger pouch portion (thumb pouch portion) are provided on a fingertip side of the five finger trunk portion. A three finger trunk portion and a fifth finger pouch portion (pinky finger pouch portion) are provided on a fingertip side of the four finger trunk portion. A second finger pouch portion (index finger pouch portion), a third finger pouch portion (middle finger pouch portion), and a fourth finger pouch portion (ring finger pouch portion) are provided on a fingertip side of the three finger trunk portion. The first to fifth finger pouch portions may be each formed to have either an open fingertip portion or a closed fingertip portion.

The fibers composing the glove are not particularly limited and are exemplified by: natural fibers such as cotton and linen; synthetic fibers such as nylon fibers, polyester fibers, rayon fibers, acrylic fibers, aramid fibers, high-strength polyethylene fibers, and polyurethane fibers; metallic fibers such as stainless-steel fibers; inorganic fibers such as glass fibers; and the like. These fibers may be used alone or in mixture of two or more types thereof. As fibers used in mixture of two, composite fibers obtained by covering stainless fibers with nylon or the like may be exemplified.

Fineness of the yarn used for the glove is not particularly limited, and is for example, 78 to 1,550 dtex. A gauge of the glove is not particularly limited and is for example, 7 to 18.

Figure 2:
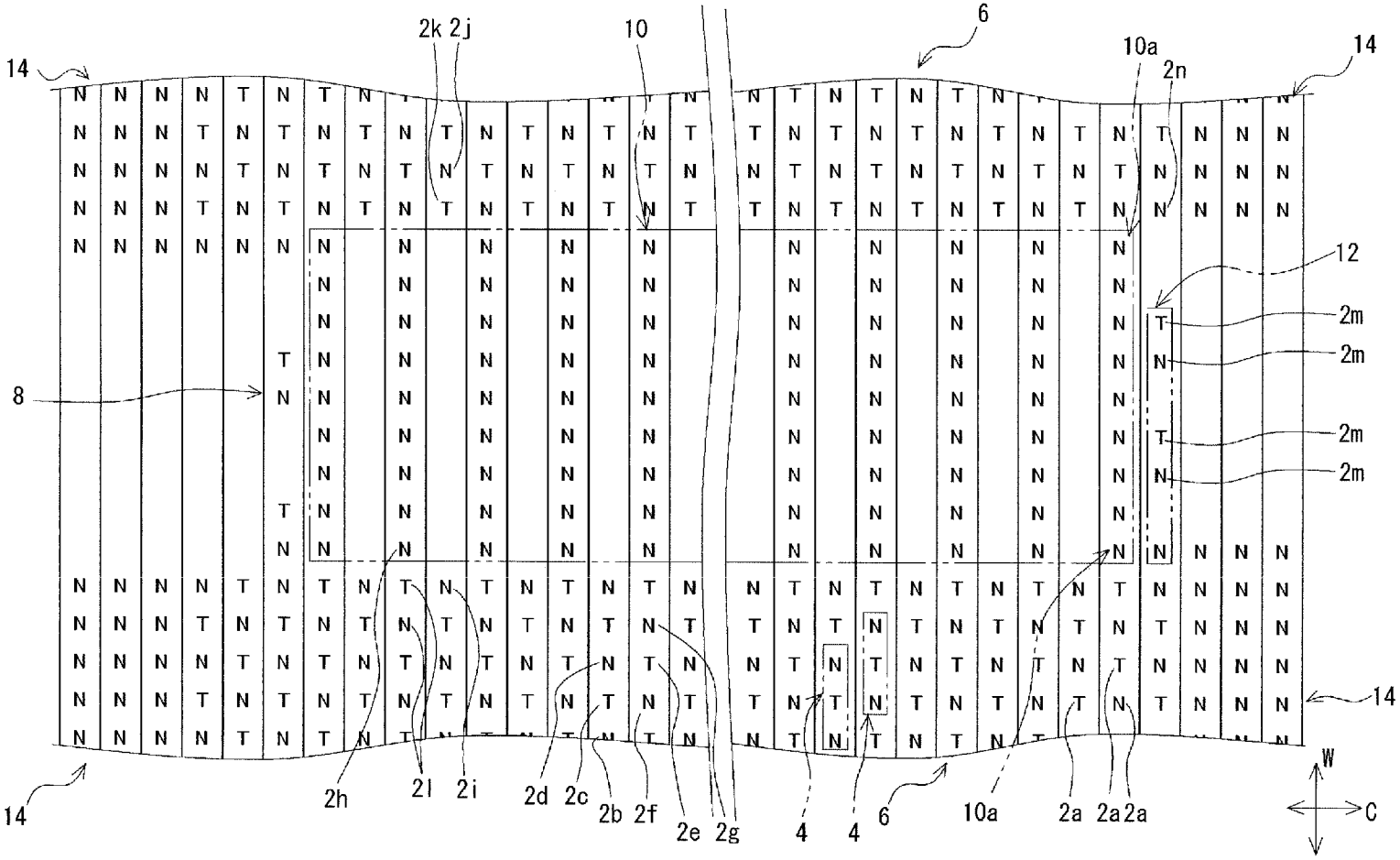
FIG. 2 is an explanatory diagram illustrating a knitted state of the glove according to the embodiment of the present invention.
Figure 3:
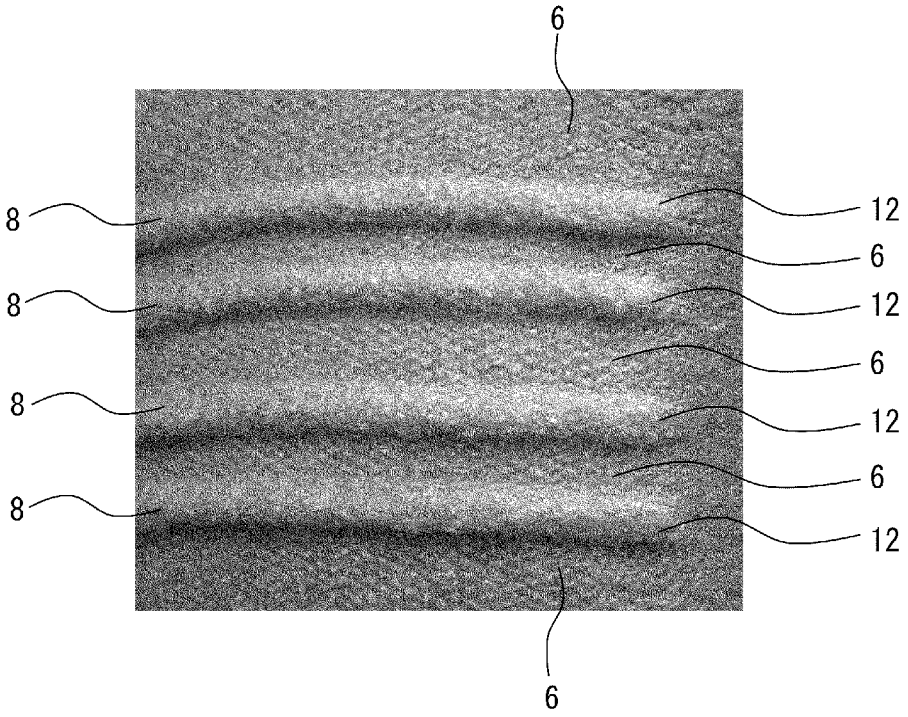
FIG. 3 is a schematic enlarged perspective view of a substantial part of the glove of FIG. 1.

The knitted fabric of the glove comprises at least one irregular surface portion 6 comprising a plurality of tucked parts 4 that are arranged in a scattered manner, and a plurality of rib portions 8 that are in proximity to the irregular surface portion 6 and provided along the course direction C. Due to the rib portions 8 being provided, improvements of cut resistance, impact resistance, and abrasion resistance of the glove are achieved. As illustrated in FIG. 3, the glove is provided with the irregular surface portion 6: adjacent to and between the plurality of rib portions 8; and adjacent to and on both sides of the rib portion 8 in the wale direction W. In the present embodiment, a flat face portion 14 formed by flat knitting is provided adjacent to and on both sides of the rib portion 8 in the course direction C; however, the flat face portion 14 may also be constituted of the irregular surface portion 6. It is to be noted that the tucked part 4 as referred to means a part where at least two stitches adjacent to each other in the wale direction W engage with one stitch adjacent to the at least two stitches in the wale direction W, and more specifically a part where two stitches 2*b* and 2*c* adjacent to each other in the wale direction W engage with one stitch 2*d*, as illustrated in FIG. 2. Due to the tucked part in which a plurality of stitches engage with one stitch, the irregular surface portion 6 is non-flat and breathability of the knitted fabric is ensured.

Figure 1:
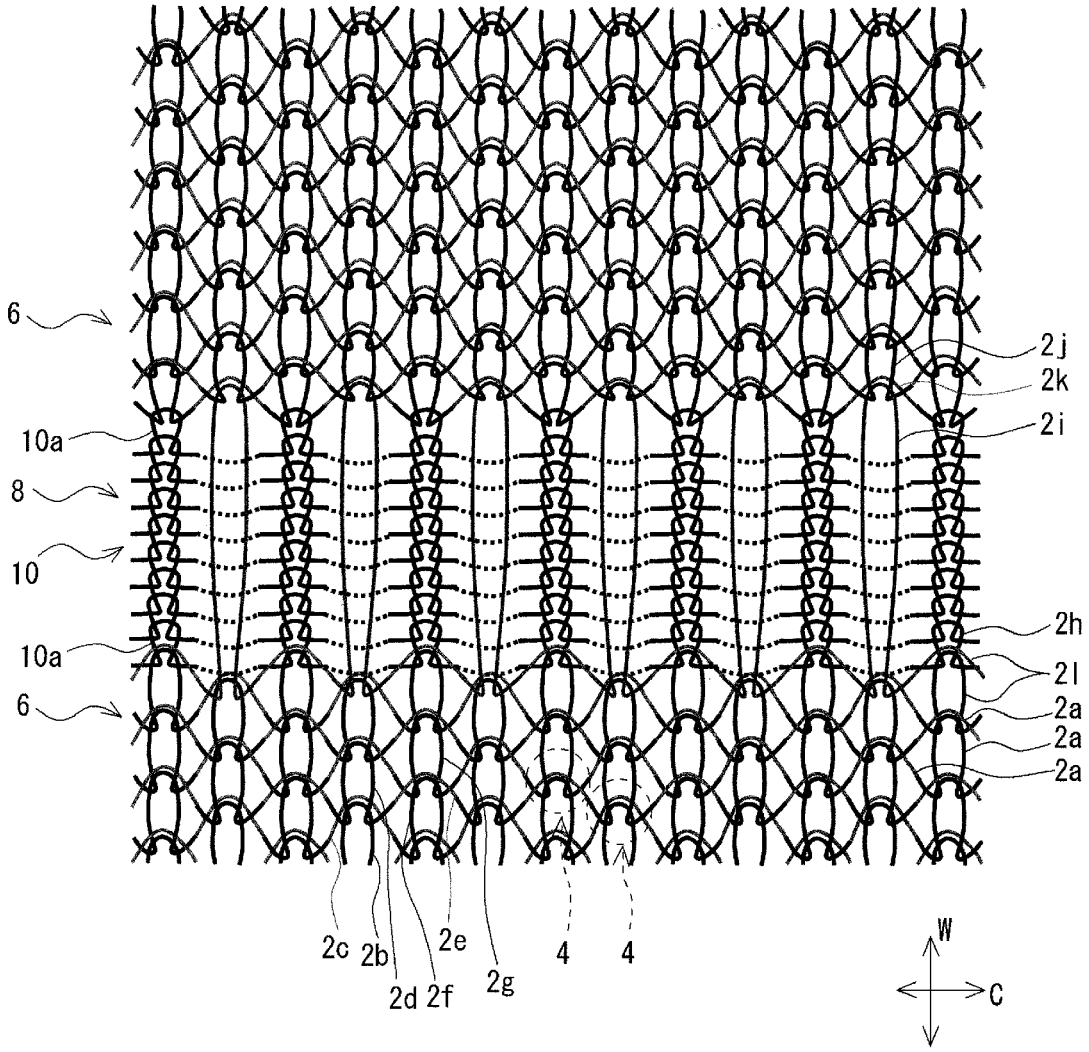
FIG. 1 is a schematic enlarged plan view of a substantial part of a glove according to an embodiment of the present invention.

The plurality of tucked parts 4 are arranged uniformly in both the course direction C and the wale direction W in the irregular surface portion 6. In the present embodiment, the plurality of tucked parts 4 are arranged in a checkerboard pattern in a planar view. More specifically, as illustrated in FIG. 2, another stitch 2*e*, which is adjacent in the course direction C to the one stitch 2*d* with which the two stitches 2*b* and 2*c* adjacent thereto in the wale direction W engage, engages with a stitch 2*g*, which is adjacent to a second side in the wale direction W (side yet to be formed), together with a stitch 2*f*, which is adjacent to a first side of the another stitch 2*e* in the wale direction W (side already formed (lower side in FIGS. 1 and 2)). It is to be noted that, in FIG. 2, N represents a stitch (2*d* and 2*g*) with which a stitch already formed (2*b*, 2*c*, 2*e*, and 2*f* in the foregoing description) engage; and T represents a stitch (2*c* and 2*e*) that engages with a stitch yet to be formed (2*d* and 2*g*), together with a stitch already formed (2*b* and 20 (symbols being used merely for explanation). In FIG. 2, knitting proceeds from a lower side (fingertip side) to an upper side (hem side). FIG. 2 illustrates a knitted state of a palm side. A dorsal side is knitted between courses for the palm side. In other words, a course for the palm side and a course for the dorsal side are alternately and successively knitted, thereby knitting the glove in a cylindrical shape. It is also to be noted that FIG. 2 illustrates only a knitted state in the vicinity of one rib portion.

The glove comprises the irregular surface portions 6 and the rib portions 8 on the palm side, and the plurality of (four in the present embodiment) rib portions 8 are provided in the five finger trunk portion and the four finger trunk portion along a transverse direction (direction orthogonal to a finger direction). The rib portion 8 may also be provided on each of the finger pouch portions. The dorsal side of the glove is formed to have a flat face by flat knitting, but may also be provided with the irregular surface portion 6 and the like.

An average thickness of the irregular surface portion 6 of the glove is not particularly limited, and the upper limit of the average thickness is preferably 3 mm, and more preferably 2 mm. The lower limit of the average thickness of the irregular surface portion 6 is preferably 0.3 mm, and more preferably 0.5 mm. In the case of the average thickness of the irregular surface portion 6 being greater than the upper limit, flexibility of the glove may decrease due to the increased thickness, leading to a deterioration of wearing feel. To the contrary, in the case of the average thickness of the irregular surface portion 6 being less than the lower limit, strength of the glove may be insufficient, leading to a decrease in durability. It is to be noted that the average thickness is an average of values obtained by measuring at arbitrary five points by a constant pressure thickness gauge conforming to JIS-L1086/L1096 (e.g., PG-15 available from TECLOCK Corporation).

An average height of the rib portion 8 is not particularly limited, and the upper limit of the average thickness is preferably 8 mm, and more preferably 5 mm. The lower limit of the average height of the rib portion 8 is preferably 1 mm, and more preferably 1.5 mm. In the case of the average height of the rib portion 8 being greater than the upper limit, the rib portion 8 becomes too high and may deteriorate wearing feel. To the contrary, in the case of the average height of the rib portion 8 being less than the lower limit, the rib portion 8 may not provide sufficient effects of improving cut resistance, impact resistance and abrasion resistance. It is to be noted that the average height is an average of values obtained by measuring at arbitrary five points by a constant pressure thickness gauge conforming to JIS-L1086/L1096 (e.g., PG-15 available from TECLOCK Corporation).

A ratio of the average height of the rib portion 8 to the average thickness of the irregular surface portion 6 is not particularly limited, and preferably no less than 1.3 and no greater than 4. When the ratio is less than the lower limit, the height of the rib portion 8 is insufficient and the rib portion 8 may not provide sufficient effects of improving cut resistance, impact resistance and abrasion resistance; or the irregular surface portion 6 becomes too thick, leading to a decrease in flexibility and, in turn, a deterioration of wearing feel. To the contrary, when the ratio is greater than the upper limit, the rib portion 8 becomes too high, leading to a deterioration of wearing feel, or the irregular surface portion 6 becomes too thin, leading to decreases in strength and durability of the glove.

The length (length in a ridge line direction) of the rib portion 8 is not particularly limited. A ratio of the length of the rib portion 8 to the length of the glove at a position at which the rib portion 8 is formed (the length of the glove along the ridge line direction of the rib portion 8 (in the present embodiment, the length of the five finger trunk portion or the four finger trunk portion in the course direction C)) is not particularly limited either. However, the ratio is preferably no less than 0.05. In the case of the ratio being less than the lower limit, the rib portion 8 may not provide sufficient effects of improving cut resistance, impact resistance and abrasion resistance. The upper limit of the ratio is, for example, 1. It is to be noted that the length of the rib portion 8 and the length of the glove at a position at which the rib portion 8 is formed can be measured by a digital caliper (e.g., CD-20C available from Mitutoyo Corporation). In a case in which the rib portion 8 is formed in the finger pouch portion or the three finger trunk portion, the "length of the glove at a position at which the rib portion 8 is formed" as referred to means a length in the course direction C of the finger pouch portion or the three finger trunk portion in which the rib portion 8 is formed (length of the finger pouch portion or the three finger trunk portion in the ridge line direction of the rib portion 8).

The rib portion 8 has a rib main body part 10 having a cylindrical shape constituted from a plurality of stitches **2*h* arranged successively in the course direction C and engaged with corresponding stitches 2*h* arranged in the wale direction W, with a region between a pair of base ends 10*a* of the rib main body part 10 being contracted. In the present embodiment, the rib main body part 10 is formed in a cylindrical shape in such a way that the plurality of stitches 2*h* arranged successively in the course direction C engage with the stitches 2*h* in another course that is adjacent thereto in the wale direction W, respectively, and the region between the pair of base ends 10*a* is contracted in the wale direction W. The irregular surface portion 6 is arranged to be adjacent to both sides of the rib main body part 10 in the wale direction W. In the present embodiment, one base end 10*a* of the rib main body part 10 (base end 10*a* on the fingertip side) is knitted subsequent to knitting of the flat face portion 14 on one side of the rib portion 8 in the course direction C (on the right side in FIG. 2), and the flat face portion 14 on the other side of the rib portion 8 in the course direction C (on the left side in FIG. 2) is knitted subsequent to knitting of the other base end 10*a* of the rib main body part 10 (base end 10*a*** on the hem side).

The number of stitches **2*h* constituting the rib main body part 10 in the course direction C is less than the number of stitches 2*a* of the adjacent irregular surface portion 6 in the course direction C. Specifically, the number of stitches 2*h* constituting the rib main body part 10 in the course direction C is about half the number of stitches 2*a* of the irregular surface portion 6 having the same width in the course direction C ((the number of stitches 2*a* of the irregular surface portion 6 in the course direction C+1)/2). In other words, among the plurality of stitches 2*a* in the irregular surface portion 6 adjacent to the rib main body part 10, a plurality of stitches 2*i* do not engage with the rib main body part 10 (hereinafter, the stitches 2*i*** may be also referred to as stitches for contraction).

Among the plurality of stitches being adjacent to the rib main body part 10 in the one irregular surface portion 6 (irregular surface portion 6 on the fingertip side) of the pair of irregular surface portions 6 adjacent to both sides of the rib main body part 10, at least one stitch **2*i* engages with a stitch 2*j* in the other irregular surface portion 6 (irregular surface portion 6 on the hem side). In other words, the stitches for contraction 2*i* engage with the stitches 2*j* in the opposite irregular surface portion 6 across the rib main body part 10, thereby contracting the region between the pair of base ends 10*a* of the rib main body part 10** as described above.

In the aforementioned situation, the stitch **2*i* (the stitch for contraction) in the one irregular surface portion 6 that engages with the stitch 2***j* in the other irregular surface portion 6 (irregular surface portion on the hem side) engages with the stitch 2*j* together with at least one stitch 2*k* among a plurality of stitches in the other irregular surface portion 6 that are adjacent to the rib main body part 10. Specifically, the stitch for contraction 2*i*, together with the first stitch 2*k* in the opposite irregular surface portion 6 across the rib main body part 10, engages with the stitch 2*j* that is adjacent to the stitch 2*k* in the wale direction W.

Meanwhile, with a stitch 2*h* at one base end 10*a* of the rib main body part 10 (stitch 2*h* at the base end 10*a* on the lower side in FIG. 2), two stitches 2*l* (stitches 2*l* in the irregular surface portion 6) that are adjacent to one side of the stitch 2*h* in the wale direction W engage.

In addition, the rib portion 8 comprises a filling part 12 formed with a stitch 2*m* that is subsequent to the stitches 2*h* of the rib main body part 10 in the course direction C. The number of the stitches in the wale direction W in the filling part 12 is less than the number of the stitches in the wale direction W in the rib main body part 10. In the glove, a hole on a side of the cylindrical rib main body part 10 is suitably filled by the filling part 12. Specifically, the number of the stitches 2*h* in the wale direction W in the rib main body part 10 is nine, while the number of the stitches 2*m* in the wale direction W in the filling part 12 is five. In the aforementioned situation, the lower limit of a ratio of the number of the stitches 2*m* in the filling part 12 in the wale direction W to the number of the stitches 2*h* in the rib main body part 10 in the wale direction W is preferably 0.2 and more preferably 0.4. Meanwhile, the upper limit of the ratio is preferably 0.8 and more preferably 0.7. When the ratio does not fall within the above range, the filling part 12 may not exert the effect sufficiently.

In the filling part 12, at least two of the stitches 2*m* in the wale direction W engage with the stitches 2*m* and 2*n* that are adjacent to the stitches 2*m* in the wale direction W.

Production Method of Glove

A production method of the glove will be described hereinafter. For the portions explained in the foregoing, explanations thereof may be omitted in the following description of the production method of the glove.

In the production method of a glove, the glove is formed in such a way that the plurality of stitches 2*a* arranged successively in the course direction C engage with corresponding stitches 2*a* in the wale direction W, respectively, and the production method comprises: knitting the irregular surface portion 6 comprising the plurality of tucked parts 4 that are arranged in a scattered manner; and knitting the rib portion 8 that is in proximity to the irregular surface portion 6 and provided along the course direction C.

Each step of the production method of the glove is conducted by a weft knitting machine. A conventionally known weft knitting machine can be used as the weft knitting machine. More specifically, the weft knitting machine is provided with front and rear needle beds in a pair, and a large number of knitting needles arranged in the needle beds, the knitting needles being disposed to be projectable and retractable through needle openings on the needle bed. The knitting needle has a butt which can be caught by and released from a cam mechanism, and is configured to be projected and retracted through the needle opening as the butt is caught by the cam mechanism. In addition, each knitting needle is disposed to be swingable in the needle bed so as to make the butt caught and released with respect to the cam mechanism. Consequently, any desired knitting method can be performed by controlling operation of each of the knitting needles.

In the knitting of the irregular surface portion, the irregular surface portion 6 is formed during knitting of the palm side. In the knitting of the irregular surface portion, a course for the palm side and a course for the dorsal side are alternately and successively knitted.

During knitting of the irregular surface portion 6, a plurality of knitting needles conduct a knitting operation and a tucking operation alternately, in one course. In other words, in one course, a knitting needle conducts the knitting operation, while a knitting needle adjacent to the knitting needle conducts the tucking operation. Each of the knitting needles conducts the knitting operation and the tucking operation alternately in every course. In other words, a knitting needle having conducted the knitting operation in the previous course conducts the tucking operation in the present course, while a knitting needle having conducted the tucking operation in the previous course conducts the knitting operation in the present course. As a result, the plurality of tucked parts 4 are arranged uniformly in both the wale direction W and the course direction C in the irregular surface portion 6. The term "knitting operation" as referred to means a series of operations in which a knitting needle moves up to feed a hook with a yarn while retaining a first stitch (stitch already formed), and then the knitting needle moves down through the first stitch to form a second stitch. This knitting operation makes the second stitch in such a way that the first stitch engages with the second stitch. The term "tucking operation" as referred to means a series of operations in which a knitting needle moves up to feed a hook with a yarn while holding a first stitch, and then the knitting needle moves down without going through the first stitch, and consequently the first stitch and the yarn thus fed are trapped in the hook. This tucking operation makes the second stitch in such a way that the second stitch does not engage with the first stitch, and the first and second stitches are retained.

In the knitting of the rib portion, the rib portion 8 is formed on the palm side. The knitting of the rib portion is conducted subsequently to the knitting of the irregular surface portion, thereby providing the rib portion 8 to be adjacent to the irregular surface portion 6 in the wale direction W. It is to be noted that "the knitting of the rib portion is conducted subsequently to the knitting of the irregular surface portion" as referred to means that these operations of knitting are successive on the palm side, and one course on the dorsal side is knitted between the knitting of the irregular surface portion and the knitting of the rib portion. In addition, the knitting of the irregular surface portion is conducted subsequently to the knitting of the rib portion, thereby providing the irregular surface portion 6 adjacently on both sides of the rib portion 8 in the wale direction W. It is to be noted that "the knitting of the irregular surface portion is conducted subsequently to the knitting of the rib portion" as referred to means that these operations of knitting are successive on the palm side, and one course on the dorsal side is knitted between the knitting of the irregular surface portion and the knitting of the rib portion.

In the knitting of the rib portion, the filling part 12 is knitted together with the knitting of the rib main body part 10. During the knitting of the rib main body part 10 and the filling part 12, knitting is not conducted on the dorsal side and knitting is conducted only on the palm side.

The knitting of the rib main body part 10 is conducted by flat knitting of the stitches 2*h*, of which number is about half the number of stitches in the irregular surface portion 6 having the same width. Specifically, the rib main body part 10 is formed by every second knitting needle. In other words, a knitting needle that is positioned between the knitting needles for knitting the rib main body part 10 (hereinafter, may be also referred to as "non-operating knitting needle") does not operate during formation of the rib portion 8. The knitting of the rib main body part 10 is conducted by the knitting needles having conducted the tucking operation in the immediate previous course (final line in the knitting of the one irregular surface portion 6). As a result, the two stitches 2*l* in the one irregular surface portion 6 engage with the stitch 2*h* at the one base end 10*a* of the rib main body part 10.

The knitting of the filling part 12 is conducted by a knitting needle that is adjacent to an outer side of the outermost knitting needle among the knitting needles for knitting the rib main body part 10. In the knitting of the rib portion, the knitting needle for knitting the filling part 12 operates less frequently than the knitting needle for knitting the rib main body part 10. Specifically, in the knitting of the rib portion, the knitting needle for knitting the rib main body part 10 operates for nine courses, while the knitting needle for knitting the filling part 12 operates for five courses. The knitting needle for knitting the filling part 12 conducts the tucking operation between a plurality of knitting operations.

As described above, after the knitting of the other base end 10*a* of the rib main body part 10, the knitting of the subsequent irregular surface portion is conducted successively.

In the first course in the knitting of the subsequent irregular surface portion, the knitting needle having knitted the rib main body part 10 conducts the knitting operation, while the non-operating knitting needle conducts the tucking operation. Meanwhile, the knitting needle having knitted the filling part 12 conducts the knitting operation.

Then, in the subsequent course (second course in the knitting of the irregular surface portion 6), the non-operating knitting needle conducts the knitting operation. As a result, the stitch for contraction 2*i* in the one irregular surface portion 6, together with the stitch 2*k* in the other irregular surface portion 6, engage with the stitch 2*j* that is adjacent to the stitch 2*k* in the wale direction W. As a result, the region between the pair of base ends 10*a* of the rib main body part 10 is contracted, thereby forming the rib main body part 10 in a cylindrical shape. In this course, the knitting needle having knitted the rib main body part 10 conducts the tucking operation, while the knitting needle having knitted the filling part 12 conducts the knitting operation.

In the present embodiment, five (n) sets of the knitting of the irregular surface portion and four (n−1) sets of the knitting of the rib portion are alternately and successively conducted, thereby forming four rib portions 8 and five irregular surface portions 6.

Advantages

The glove is superior in breathability in the irregular surface portion and also superior in sweat-absorbent and quick-drying properties, and wearing feel, due to the irregular surface portion 6 comprising a plurality of tucked parts 4 that are arranged in a scattered manner, since the tucked parts 4 have more voids in the knitted fabric than the flat face portion formed only by knitting. In particular, the plurality of tucked parts 4 being arranged uniformly in both the course direction C and the wale direction W in the irregular surface portion 6 enable an improvement in breathability in both the course direction C and the wale direction W, and in turn improvements of the sweat-absorbent and quick-drying properties, and wearing feel. In addition, the irregular surface portion 6 and the rib main body part 10 being arranged adjacently result in superior breathability of a part in proximity to the rib main body part 10.

Due to comprising the rib main body part 10 having the cylindrical shape with the region between the pair of base ends 10*a* being contracted, the rib portion 8 is enabled to be formed correctly and easily. In addition, due to engaging the stitch for contraction 2*i* in the one irregular surface portion 6 of the irregular surface portions 6 on both sides of the rib portion 8 in the wale direction W with the stitch 2*j* in the other irregular surface portion 6, contraction of the region between the pair of base ends 10*a*, and in turn correct and easy formation of the rib portion 8, are enabled. Furthermore, due to the stitch for contraction 2*i*, together with the first stitch 2*k* in the opposite irregular surface portion 6 across the rib main body part 10, engaging with the stitch 2*j* that is adjacent to the stitch 2*k* in the wale direction W, more certain formation of the rib portion 8 and ensuring breathability in this portion are enabled.

Due to the stitch 2*h* at one of the pair of base ends 10*a* of the rib main body part 10 having the two stitches 2*l* in the irregular surface portion 6 that are adjacent to the stitch 2*h* in the wale direction W being engaged therewith, joint strength between the rib main body part 10 and the irregular surface portion 6 is increased, and ensuring of breathability in these parts is enabled.

In addition, due to the rib portion 8 comprising the filling part 12 constituted of the stitches 2*m* that are subsequent to the stitches 2*h* in the rib main body part 10 in the course direction C and of which number in the wale direction W is less than the number of the stitches 2*h* in the in the rib main body part 10 in the wale direction W, correct preclusion of a void at a side end of the rib main body part 10 is enabled.

Other Embodiments

The present invention is not limited to the above embodiment and may be carried out in various modified and improved modes in addition to the aforementioned modes.

In the above embodiment, the plurality of tucked parts 4 being arranged uniformly in both the course direction C and the wale direction W in the irregular surface portion 6 have been described; however, the present invention is not limited thereto and the plurality of tucked parts 4 may also be arranged randomly.

In addition, even in the case in which the plurality of tucked parts 4 are arranged uniformly in both the course direction C and the wale direction W in the irregular surface portion 6, the present invention is not limited to the mode in which the knitting operation and the tucking operation are conducted alternately in the wale direction W and the course direction C as in the above embodiment. The present invention may be also carried out in a mode in which the plurality of tucked parts 4 are arranged as illustrated in FIGS. 4 to 7.

Figure 4:
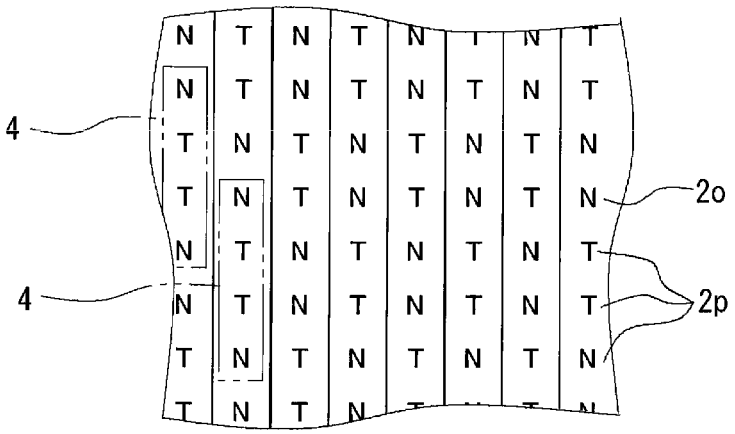
FIG. 4 is an explanatory diagram illustrating a knitted state of a glove according to another embodiment of the present invention.

In the glove illustrated in FIG. 4, the plurality of tucked parts 4, in each of which at least three stitches 2*p* engage with one stitch 2*o*, are arranged regularly in a checkerboard pattern by repeating a plurality of times a set of operations: in a plurality of courses (two courses in the illustrated example), the tucking operation is conducted by every second knitting needles and the knitting operation is conducted by knitting needles other than the every second knitting needles; and in the subsequent plurality of courses (the same number of courses as the previous plurality of courses (two courses in the illustrated example)), the knitting operation is conducted by the every second knitting needles and the tucking operation is conducted by the knitting needles other than the every second knitting needles.

Figure 5:
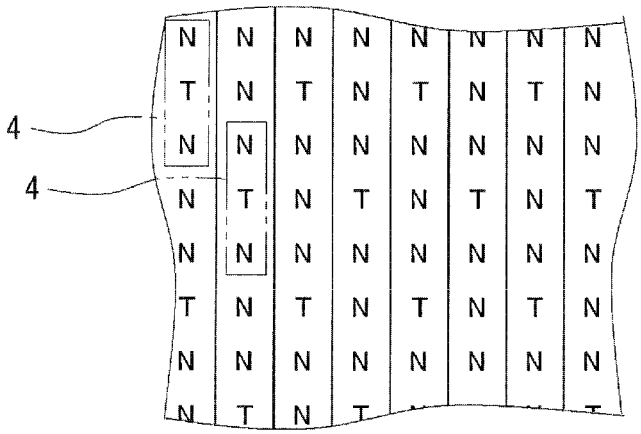
FIG. 5 is an explanatory diagram illustrating a knitted state of a glove according to still another embodiment of the present invention.

Knitting of the glove illustrated in FIG. 5 comprises a course in which only the knitting operation is conducted (no tucking operation is conducted), between courses of conducting the tucking operation. Specifically, the plurality of tucked parts 4 are arranged regularly in the course direction C and the wale direction W by repeating a plurality of times a set of operations: in a first course, the tucking operation is conducted by every second knitting needles and the knitting operation is conducted by knitting needles other than the every second knitting needles; in a second course, the knitting operation is conducted by all of the knitting needles; in a third course, the knitting operation is conducted by the every second knitting needles and the tucking operation is conducted by the knitting needles other than the every second knitting needles; and in a fourth course, the knitting operation is conducted by all of the knitting needles.

Figure 6:
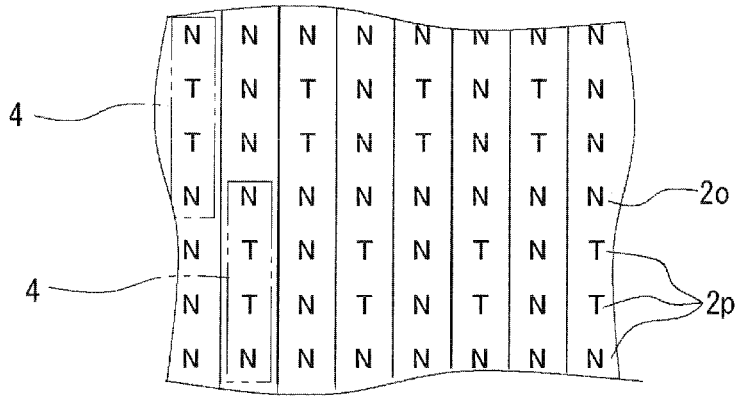
FIG. 6 is an explanatory diagram illustrating a knitted state of a glove according to yet another embodiment of the present invention.

The glove illustrated in FIG. 6 is a modification of the glove illustrated in FIG. 5. In this modification, the tucking operation and the knitting operation are conducted by the every second knitting needles and the knitting needles other than the every second knitting needles in a plurality of courses instead of one, and the knitting operation is conducted by the all of the knitting needles in one or a plurality of courses. Specifically, the plurality of tucked parts 4 are arranged regularly in the course direction C and the wale direction W by repeating a plurality of times a set of operations: first, in a plurality of courses (two courses in the illustrated example), the tucking operation is conducted by every second knitting needles and the knitting operation is conducted by knitting needles other than the every second knitting needles; second, in one course, the knitting operation is conducted by all of the knitting needles; third, in a plurality of courses, the knitting operation is conducted by the every second knitting needles and the tucking operation is conducted by the knitting needles other than the every second knitting needles; and fourth, in one course, the knitting operation is conducted by all of the knitting needles. Due to the tucked part 4 being formed such that at least three stitches (three stitches 2*p* in the illustrated example) adjacent to the stitch 2*o* in the wale direction W engage with the first stitch 2*o*, a breathability improving effect at the tucked part 4 is further enhanced in the glove illustrated in FIG. 6, compared to the glove illustrated in FIG. 5.

Figure 7:
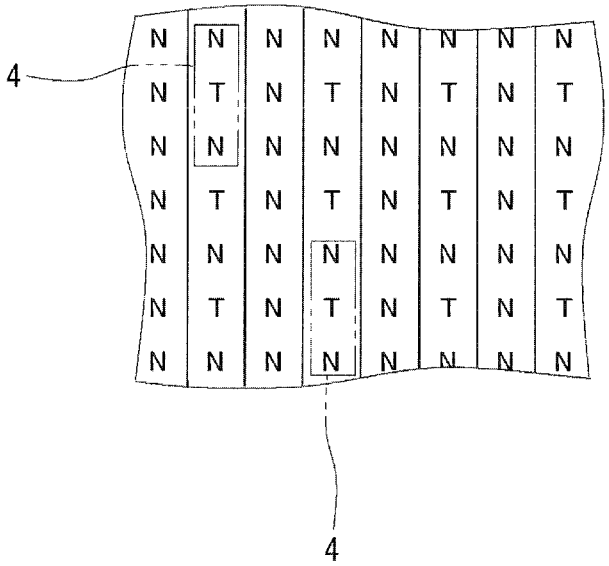
FIG. 7 is an explanatory diagram illustrating a knitted state of a glove according to a further embodiment of the present invention.

It is also possible to conduct the knitting operation and the tucking operation alternately, with the knitting needles at the same positions, as illustrated in FIG. 7. Specifically, in FIG. 7, the plurality of tucked parts 4 are arranged uniformly in the wale direction W and the course direction C by repeating a plurality of times a set of operations: in a first course, the tucking operation is conducted by every second knitting needles and the knitting operation is conducted by knitting needles other than the every second knitting needles; in a second course, the knitting operation is conducted by all of the knitting needles; in a third course, the tucking operation is conducted by the every second knitting needles and the knitting operation is conducted by the knitting needles other than the every second knitting needles; and in a fourth course, the knitting operation is conducted by all of the knitting needles.

In the case of arranging the plurality of tucked parts 4 uniformly in both the wale direction W and the course direction C in the irregular surface portion 6 as described above, the modes illustrated in FIGS. 4 to 7 may be employed. Of these, the mode illustrated in FIG. 4 or FIG. 6 is preferred. In other words, as illustrated in FIG. 4 or FIG. 6, it is preferred that the tucked part 4 is formed in such a way that at least three stitches (three stitches 2*p* in the illustrated example) that are adjacent to one stitch 2*o* in the wale direction W engage with the one stitch 2*o*. As a result, the breathability improving effect at the tucked part 4 is further enhanced.

Figure 8:
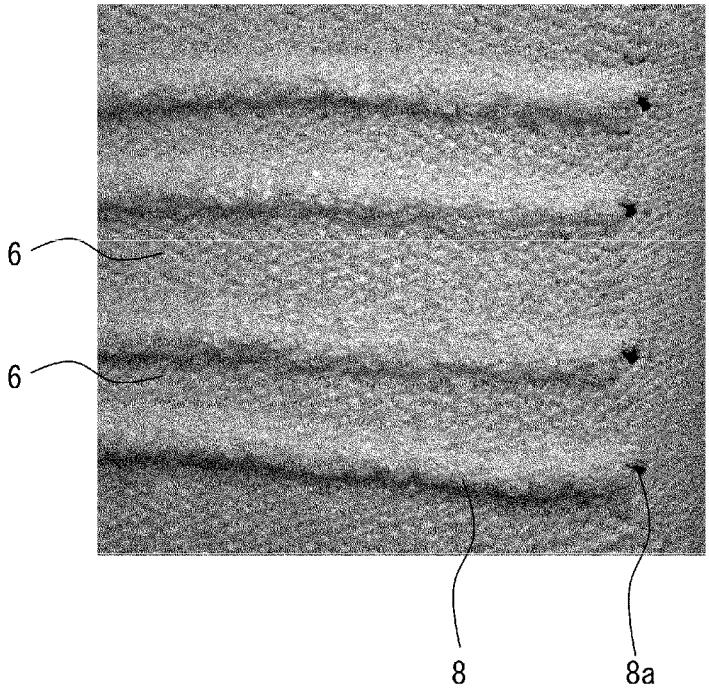
FIG. 8 is a schematic enlarged perspective view of a substantial part of a glove according to a still further embodiment of the present invention.

It is to be noted that, in the above embodiment, the rib portion 8 comprising the filling part 12 has been described; however, the present invention is not limited thereto and the rib portion 8 may have voids 8*a* at both side ends thereof as illustrated in FIG. 8.

INDUSTRIAL APPLICABILITY

The glove according to any one the embodiments of the present invention is superior in breathability, sweat-absorbent and quick-drying properties, and wearing feel as described above. The glove may therefore be suitably used as a work glove.

EXPLANATION OF THE REFERENCE SYMBOLS

2*a* to 2*p* Stitch
4 Tucked part
6 Irregular surface portion
8 Rib portion
10 Rib main body part
12 Filling part
14 Flat face portion
C Course direction
W Wale direction

What is claimed is:

1. A glove comprising a knitted fabric, wherein:

the knitted fabric is constituted from a plurality of stitches arranged successively in a course direction and engaged with corresponding stitches arranged in a wale direction;

the knitted fabric comprises at least a first surface portion and a second surface portion, the first surface portion comprising a plurality of tucked parts that are arranged in a scattered manner, and the second surface portion comprising at least one rib area that is provided in proximity to the first surface portion and along the course direction;

the rib area comprises a rib main body part having a cylindrical shape constituted from a plurality of stitches arranged successively in the course direction and engaged with corresponding stitches arranged in the wale direction, with a region between a pair of base ends of the rib main body part being contracted;

a pair of the first surface portions is arranged to be adjacent to both sides of the rib main body part in the wale direction;

among a plurality of stitches in one first surface portion that are adjacent to the rib main body part, at least one stitch engages with a stitch in other first surface portion; and the at least one stitch in the one first surface portion that engages with the stitch in the other first surface portion engages with the stitch in the other first surface portion together with at least one stitch among a plurality of stitches in the other first surface portion that are adjacent to the rib main body part.

2. The glove according to claim 1, wherein the plurality of tucked parts are arranged in the first surface portion uniformly in both the course direction and the wale direction.

3. The glove according to claim 1, wherein each of the plurality of tucked parts is formed in such a way that at least three stitches that are adjacent to one stitch in the wale direction engage with the one stitch.

4. The glove according to claim 1, wherein the second surface portion comprises a filling part formed with a stitch that is subsequent in the course direction from the stitches of the rib main body part, wherein number of the stitch in the wale direction in the filling part is less than number of the stitches in the wale direction in the rib main body part.

5. The glove according to claim 1, wherein: the first surface portion is arranged to be adjacent to at least one side of the rib main body part in the wale direction; and a stitch at one of the pair of base ends of the rib main body part has at least two stitches that are adjacent to the stitch in the wale direction being engaged.

6. A production method of a glove, the glove being constituted from a plurality of stitches arranged successively in a course direction and engaged with corresponding stitches arranged in a wale direction, the production method comprising:

knitting a first surface portion comprising a plurality of tucked parts that are arranged in a scattered manner; and knitting a second surface portion comprising at least one rib area that is in proximity to the first surface portion and provided along the course direction, wherein:

the rib area comprises a rib main body part having a cylindrical shape constituted from a plurality of stitches arranged successively in the course direction and engaged with corresponding stitches arranged in the wale direction, with a region between a pair of base ends of the rib main body part being contracted;

a pair of the first surface portions is arranged to be adjacent to both sides of the rib main body part in the wale direction;

among a plurality of stitches in one first surface portion that are adjacent to the rib main body part, at least one stitch engages with a stitch in other first surface portion; and the at least one stitch in the one first surface portion that engages with the stitch in the other first surface portion engages with the stitch in the other first surface portion together with at least one stitch among a plurality of stitches in the other first surface portion that are adjacent to the rib main body part.

* * * * *